US007654429B2

(12) United States Patent
Shea et al.

(10) Patent No.: US 7,654,429 B2
(45) Date of Patent: Feb. 2, 2010

(54) ENHANCED FUEL PASSAGEWAY AND ADAPTER COMBUSTION TOOL FUEL CELL

(75) Inventors: Maureen L. Shea, Wilmette, IL (US); Eric S. Gibson, Round Lake, IL (US); Walter J. Taylor, McHenry, IL (US); Chris H. Porth, Gurnee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 12/204,530

(22) Filed: Sep. 4, 2008

(65) Prior Publication Data

US 2009/0001120 A1 Jan. 1, 2009

Related U.S. Application Data

(62) Division of application No. 11/810,238, filed on Jun. 5, 2007, now Pat. No. 7,478,740.

(60) Provisional application No. 60/817,864, filed on Jun. 30, 2006.

(51) Int. Cl.
*B25C 1/14* (2006.01)

(52) U.S. Cl. ..... 227/10; 227/9; 227/11

(58) Field of Classification Search ..... 227/10, 227/9, 11

See application file for complete search history.

(56) References Cited

U.S. PATENT DOCUMENTS 4,403,722 A 9/1983 Nikolich
4,483,474 A 11/1984 Nikolich
4,522,162 A 6/1985 Nikolich
5,115,944 A 5/1992 Nikolich
5,263,439 A 11/1993 Doherty et al.
6,302,297 B1 10/2001 Richardson et al.
6,523,860 B1 2/2003 Shkolnikov et al.
6,626,344 B2 * 9/2003 Shkolnikov et al. ..... 227/10
6,796,478 B2 9/2004 Shkolnikov et al.
2002/0043547 A1 4/2002 Shkolnikov et al.
2002/0108992 A1 8/2002 Shkolnikov et al.
2003/0127488 A1 7/2003 Wagdy
2005/0230451 A1 10/2005 Vanstaan et al.
2007/0012267 A1 * 1/2007 Shkolnikov et al. ..... 123/46 H
2007/0074706 A1 * 4/2007 Wagdy et al. ..... 123/495

* cited by examiner

*Primary Examiner*—Brian D Nash
(74) *Attorney, Agent, or Firm*—Greer, Burns & Crain, Ltd.; Christopher P. Rauch; Mark W. Croll

(57) ABSTRACT

A combustion nailer is configured for use with a fuel cell having an internal metering valve and a reciprocating, biased main stem. The nailer includes a tool housing defining a fuel cell chamber constructed and arranged for receiving the fuel cell, a fuel cell actuator assembly configured for actuating the fuel cell in the chamber to emit a measured dose of fuel during tool operation, and a fuel delivery apparatus associated with the actuator assembly for receiving the emitted dose of fuel and providing it to a combustion chamber. The fuel delivery apparatus is configured for preventing actuation of the main stem by the actuator assembly upon the fuel cell being adapter-free.

4 Claims, 6 Drawing Sheets

ENHANCED FUEL PASSAGEWAY AND ADAPTER COMBUSTION TOOL FUEL CELL

RELATED APPLICATION

This is a divisional of application Ser. No. 11/810,238, filed Jun. 5, 2007, now U.S. Pat. No. 7,478,740, and claims priority under 35 U.S.C. 119(e) from U.S. provisional patent application Ser. No. 60/817,864 filed Jun. 30, 2006, which is incorporated herein by reference.

BACKGROUND OF THE INVENTION

This invention relates generally to improvements in fuel cell fuel delivery arrangements for use in combustion tools, and more specifically to actuating systems for metering valves used with such fuel cells for delivering the appropriate amount of fuel for use by a combustion tool during the driving of fasteners. While the present application is focused on the use of fuel cells in combustion tools, it is contemplated that other applications are contemplated in which fuel cells or other pressurized containers using stem valves are employed, such as, but not limited to cosmetics and pharmaceutical products.

As exemplified in Nikolich U.S. Pat. Nos. 4,403,722; 4,483,474; 4,522,162 and 5,115,944, all of which are incorporated by reference, it is known to use a dispenser such as a fuel cell to dispense a hydrocarbon fuel to a combustion tool, also known as a combustion gas-powered tool, such as, for example, a combustion gas-powered fastener-driving tool, also known as a combustion nailer. Such fastener-driving tools and such fuel cells are available commercially from ITW-Paslode (a division of Illinois Tool Works, Inc.) of Vernon Hills, Ill., under its IMPULSE trademark. In particular, a fuel cell of this type is described in Nikolich U.S. Pat. No. 5,115,944, listed above.

A design criterion of such fuel cells is that only a desired amount of fuel or dose of fuel should be emitted by the fuel cell for each combustion event. The amount of fuel should be carefully monitored to provide the desired combustion, yet in a fuel-efficient manner to prolong the working life of the fuel cell. Prior attempts to address this dosage factor have resulted in fuel metering valves located in the tool (U.S. Pat. No. 5,263,439) or attached to the fuel cell (U.S. Pat. No. 6,302,297), both of which are also incorporated by reference. Fuel cells have been introduced having internal metering valves, as disclosed in commonly assigned U.S. patent application Ser. No. 10/827,551, filed Apr. 19, 2004, and also incorporated by reference.

Fuel cells configured for use with external metering valves are similar in external appearance to fuel cells having internal metering valves. While adapters are known for improving performance of such combustion nailers (U.S. Pat. No. 6,796,478), and the external fuel cell metering valves of U.S. Pat. No. 6,302,297 are provided with fuel cells upon purchase, through use, it has been known for such adapters and/or valves to become dislodged from the fuel cell, resulting in fuel cells having similar external appearance, but having distinct and incompatible internal performance components.

Regardless of the location of the metering valve, the associated combustion nailer is designed to exert a force on the valve, either the reciprocating valve stem or on the valve body itself, to cause the stem to retract against a biasing force in the metering valve to dispense a measured dose of fuel. Since it is important for fuel economy in the fuel cell, and desired operation of the combustion nailer, for only the designated amount of fuel to be supplied to the tool on a dosage basis, it is also important that users of such tools associate the appropriate type of fuel cell with the appropriate tool and the corresponding metering system. It is also important that the combustion nailer be readily associated with the appropriate fuel cell.

Thus, there is a need for readily distinguishing between combustion tool fuel cells configured for use with external fuel metering valves from fuel cells having internal fuel metering valves.

BRIEF SUMMARY OF THE INVENTION

The above-listed need is met or exceeded by the present enhanced fuel passageway and adapter for combustion tool fuel cells, and an associated fuel delivery system in the combustion nailer. By using the present fuel delivery system, a tool designed for use with internal metering valve fuel cells will not function if a fuel cell requiring an external-type of metering valve and lacking the associated metering valve or adapter is installed in the tool. A specialized adapter is provided which complements the fuel delivery system in the tool, designed for fuel cells using internal metering valves. The present adapter also accommodates the reciprocal motion of the fuel cell stem, while remaining secured to the fuel cell canister.

More specifically, a combustion nailer is provided and is configured for use with a fuel cell having an internal metering valve and a reciprocating, biased main stem. The nailer includes a tool housing defining a fuel cell chamber constructed and arranged for receiving the fuel cell, a fuel cell actuator assembly configured for actuating the fuel cell in the chamber to emit a measured dose of fuel during tool operation, and a fuel delivery apparatus associated with the actuator assembly for receiving the emitted dose of fuel and providing it to a combustion chamber. The fuel delivery apparatus is configured for preventing actuation of the main stem by the actuator assembly upon the fuel cell being adapter-free.

In another embodiment, a combustion nailer and fuel cell assembly is provided, including a combustion nailer having a tool housing defining a fuel cell chamber constructed and arranged for receiving a fuel cell having a main stem and a closure, an adapter configured for frictional engagement on the closure, a fuel cell actuator assembly in operational relationship to the fuel cell chamber and configured for actuating the fuel cell in the chamber to emit a measured dose of fuel during tool operation, a fuel delivery apparatus associated with the actuator assembly and engageable on the adapter for receiving the emitted dose of fuel and providing it to a combustion chamber. The fuel delivery apparatus is configured for preventing actuation of the main stem by the actuator assembly upon the fuel cell being adapter-free.

In yet another embodiment, an adapter is provided configured for use with a combustion nailer fuel cell having a main stem and a closure with an annular ring, and for use with a nailer equipped with a fuel delivery system having an actuator block. The adapter includes an adapter body having at least one radially projecting engagement formation for frictionally engaging the annular ring; and a hub reciprocally movable relative to the body and engageable on the main stem for common movement relative to the body.

DETAILED DESCRIPTION OF THE INVENTION

Figure 1:
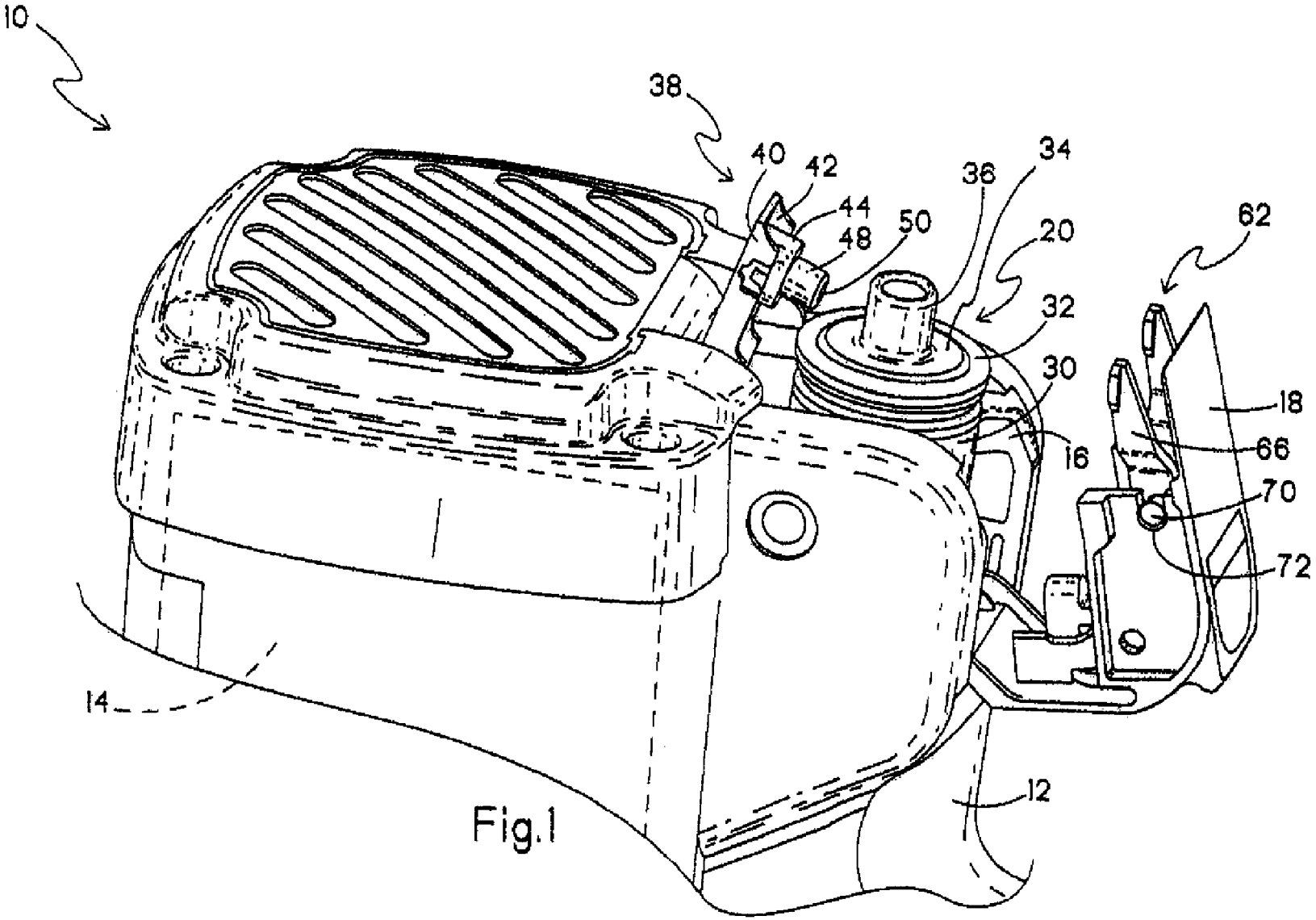
FIG. 1 is a fragmentary top perspective view of a combustion nailer configured for receiving a fuel cell with an internal metering valve.
Figure 2:
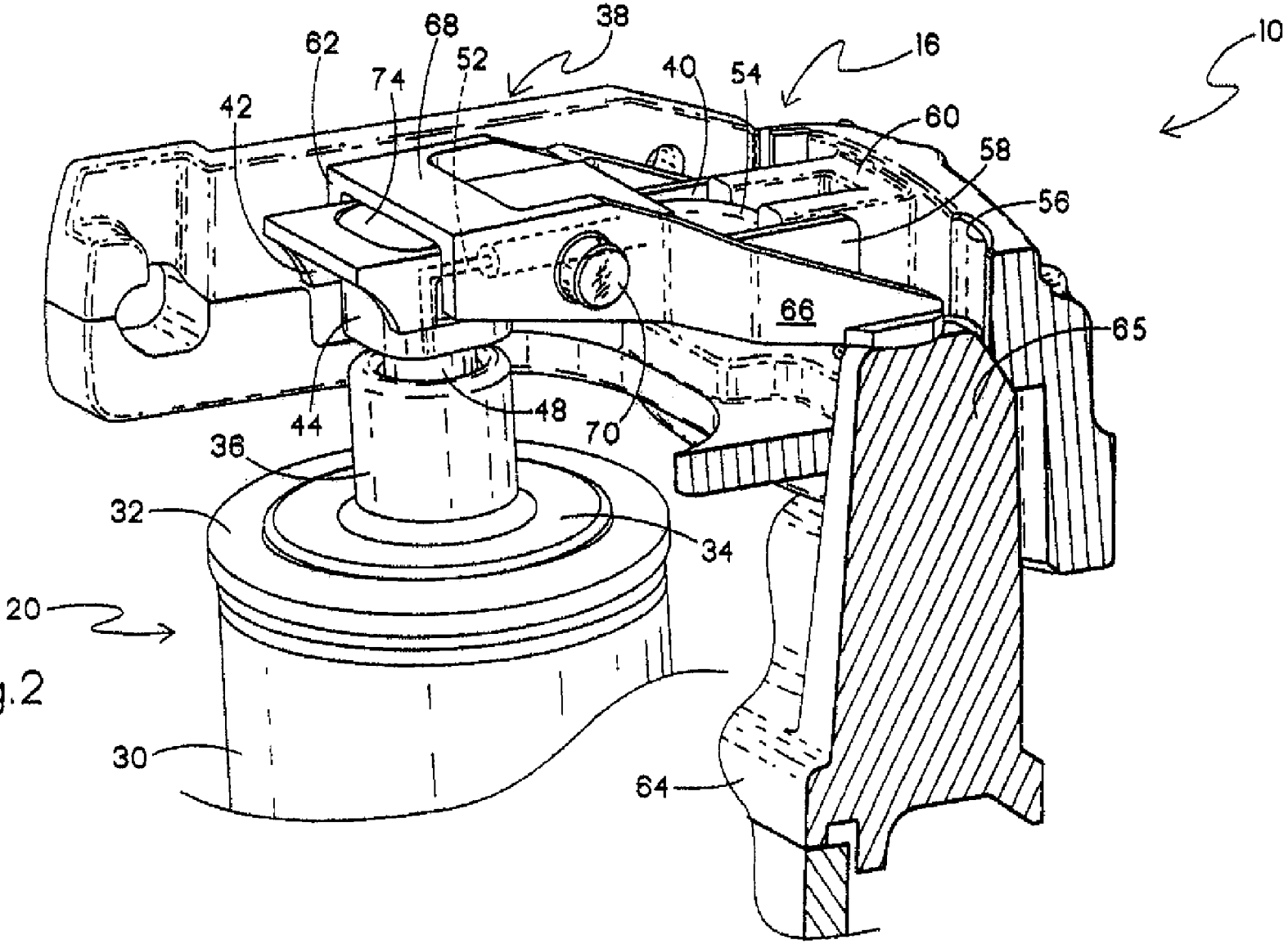
FIG. 2 is an enlarged fragmentary top perspective view of the fuel cell actuator mechanism of the nailer of FIG. 1.

Referring now to FIGS. 1 and 2, a combustion nailer is depicted, generally designated 10. The nailer 10 is described in detail in U.S. Ser. No. 11/242,311 filed Oct. 3, 2005 which is incorporated by reference. As is known in the art, a main tool housing 12 encloses a combustion chamber 14 (shown hidden) and a fuel cell chamber 16. A fuel cell door 18 is pivotally engaged on the housing 12 and is configured to close off the fuel cell chamber 16 during tool operation. The construction and arrangement of such doors is well known in the art.

As described in U.S. Pat. No. 5,263,439, incorporated by reference, inserted into the fuel cell chamber 14 is a fuel cell, generally designated 20, the general construction of which is well known in the art pertaining to combustion tools. The particular construction of the present fuel cell 20, having an internal fuel metering valve 22 (FIGS. 4 and 5) is described in copending U.S. Ser. No. 10/827,551 which has been incorporated by reference. Generally speaking, a fuel valve stem 24 is biased to a closed position, as by a spring 26, but when axially depressed, a measured dose of fuel is dispensed. Upon withdrawal of the axial force, the stem 24 resumes its rest position, and a subsequent dose of fuel flows into a metering chamber 28 for the next firing cycle.

Other major components of the fuel cell 20 include an outer shell 30, a closure 32 crimped over an upper end of the shell, and a snap fit stem protector 34. Frictionally engaged in the closure, the stem protector 34 includes a generally cylindrical sleeve 36 surrounding and extending vertically beyond an upper end of the stem 24. The sleeve 36 protects the stem 24 from damage or unwanted actuation to avoid inadvertent dispensing of fuel.

Also included on the nailer 10 is a fuel cell actuator assembly generally designated 38 which is in operational relationship with the fuel cell chamber 16 and is constructed and arranged for exerting an axial force on the fuel cell stem 24. This axial force causes the stem 24 to dispense a measured dose of fuel to the combustion chamber 14 prior to each combustion event to initiate combustion. A main component of the actuator 38 is at least one generally elongate actuator element 40 configured for exerting an axial force on the stem 24, releasing the dose of fuel. In the preferred embodiment, the element 40 is in actual contact with the stem 24.

In a generally inverted "U"-shaped channel 42 defined by the actuator element 40 is disposed a fuel delivery apparatus including a stem receiver block 44. The stem receiver block 44 is held within the channel 42 by at least one pin (not shown) passing through a corresponding bore on both the actuator element 40 and the stem receiver block. However, other types of fastening arrangements, such as threaded fasteners, chemical adhesives or the like are also contemplated. While the stem receiver block 44 is located at an end of the actuator element 40, other locations on the element are contemplated. A depending nozzle 48 on the stem receiver block 44 matingly engages the sleeve 36 and defines a socket 50 dimensioned for positively and sealingly engaging the valve stem 24. Note that in this embodiment, the nozzle 48 passes within the sleeve 36 for direct engagement with the valve stem 24.

Also included in the fuel delivery apparatus is an internal passageway 52 (shown hidden) in the stem receiver block 44 that places the fuel cell valve stem 24 in fluid communication with a fuel conduit 54 associated with the actuator element 40, in this case by being located in the channel 42. It will be understood that the passageway 52 generally defines a right angle, so that fuel dispensed by the generally vertically oriented fuel cell 20 and the stem 24 is diverted to a generally horizontal direction. However, the configuration of the passageway 52 may vary to suit the application. The fuel conduit 54 places the fuel cell valve stem 24 in fluid communication with the stem receiver block 44 and also with a cylinder head 56 of the tool 10. As is known in the art, the cylinder head 56 is one of the components defining the combustion chamber 14. Also, the fuel conduit 54 is preferably a segment of flexible tubing and is joined both to the cylinder head 56 and to the stem receiver block 44 by corresponding barbed fittings 45 (FIG. 4) at each end for sealingly transmitting the fuel to the combustion chamber 14. It is contemplated that other types of flexible or rigid conduit connection systems may be employed in this situation, depending on the application.

The actuator element 40 pivotally engages the cylinder head 56 through a pinned connection of at least one and preferably two tabs 58 at an opposite end of the element from the location of the stem receiver block 44. The tabs 58 engage ears 60 extending in a spaced, generally parallel orientation from the cylinder head 56. This pivoting connection allows the actuator 38 to be pivoted out of the way to permit a fuel cell exchange (FIG. 1).

Also included on the actuator 38 is a pivot member 62 provided for transmitting the axial force to the actuator which dispenses the measured dose of fuel from the fuel cell 20. This force originates through the retraction of a workpiece contact element (not shown), depending from a lower end of the tool. As is well known in the art of fastener driving tools, as the tool 10 is pressed against the workpiece prior to driving a fastener, the workpiece contact element retracts relative to the rest of the tool. This retraction is used to mechanically trigger other operations of the tool 10, such as the closing of a combustion chamber by a valve sleeve. In the present application, the movement of the workpiece contact element relative to the tool 10 also is used to initiate the axial force on the fuel cell stem 24 to dispense the fuel.

More specifically, the workpiece contact element is mechanically coupled to a valve sleeve 64 having at least one and preferably a plurality of vertically projecting lugs 65, (FIG. 2), the valve sleeve being slidably disposed relative to the cylinder head 56. As the tool 10 is pressed against the workpiece, through an intermediate linkage (not shown) the workpiece contact element causes the sleeve 64 and the lugs 65 to extend vertically. This upward movement causes the lugs 65 to engage corresponding arms 66 of the pivot member 62, which is generally "U"-shaped when viewed from above. In other combustion tools it is known to use link rods (not shown) to perform this function. Corresponding ends of the arms 66 are joined at a bar 68 in operational relationship to the actuator element 40, preferably above the stem receiver block 44.

A laterally extending lug 70 extends from the pivot member 62 and pivotally engages a corresponding socket or opening formation 72 (FIG. 1) in the fuel cell door 18. Thus, the pivot member 62 moves into and out of operation with the actuator element 40 with the movement of the fuel cell door 18. In FIG. 2, the tool 10 is shown in the rest position after the completion of the combustion event and the return of the tool components such as the workpiece contact element and the piston to the pre-firing position. The actuator 38 is biased to this position by the internal spring force applied to the valve stem 24 by the spring 26. The link rods 64 are seen in a retracted position.

Once the tool 10 is pressed against a workpiece and the workpiece contact element is retracted relative to the tool, the link rods 64 extend upwardly, pivoting the pivot member 62 about the lugs 70, causing the bar 68 to axially depress the actuator element 40, which in turn presses an engagement surface 74 on the stem receiver block 44 downwardly against the stem 24. This downward axial force overcomes the bias of the stem 24 and is stopped by engagement between the stem receiver block 44 against the sleeve 36, however, the vertical travel of the stem receiver block is sufficient to depress the stem 24 to release and dispense the measured dose of fuel. Thus, the actuator 38 is configured for receiving a force in a first axial direction, and associated with the actuator element 40 for generating an opposite axial force on the stem. At the conclusion of the combustion cycle, when the tool 10 is lifted from the workpiece, the link rods 64 retract and the actuator 38 resumes the rest position of FIG. 2.

Figure 3:
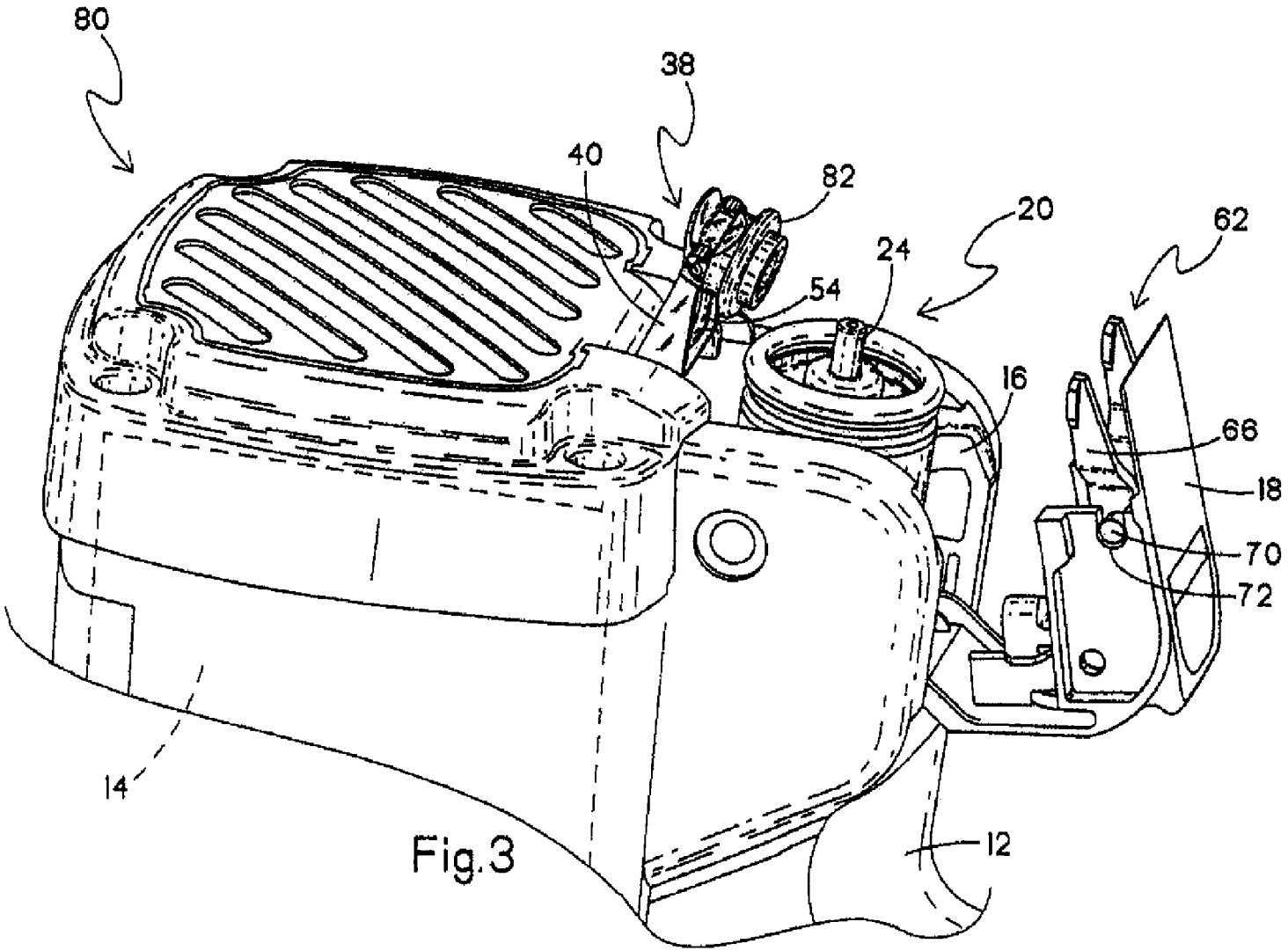
FIG. 3 is a fragmentary top perspective view of a combustion nailer equipped with the present fuel cell actuator system.
Figure 4:
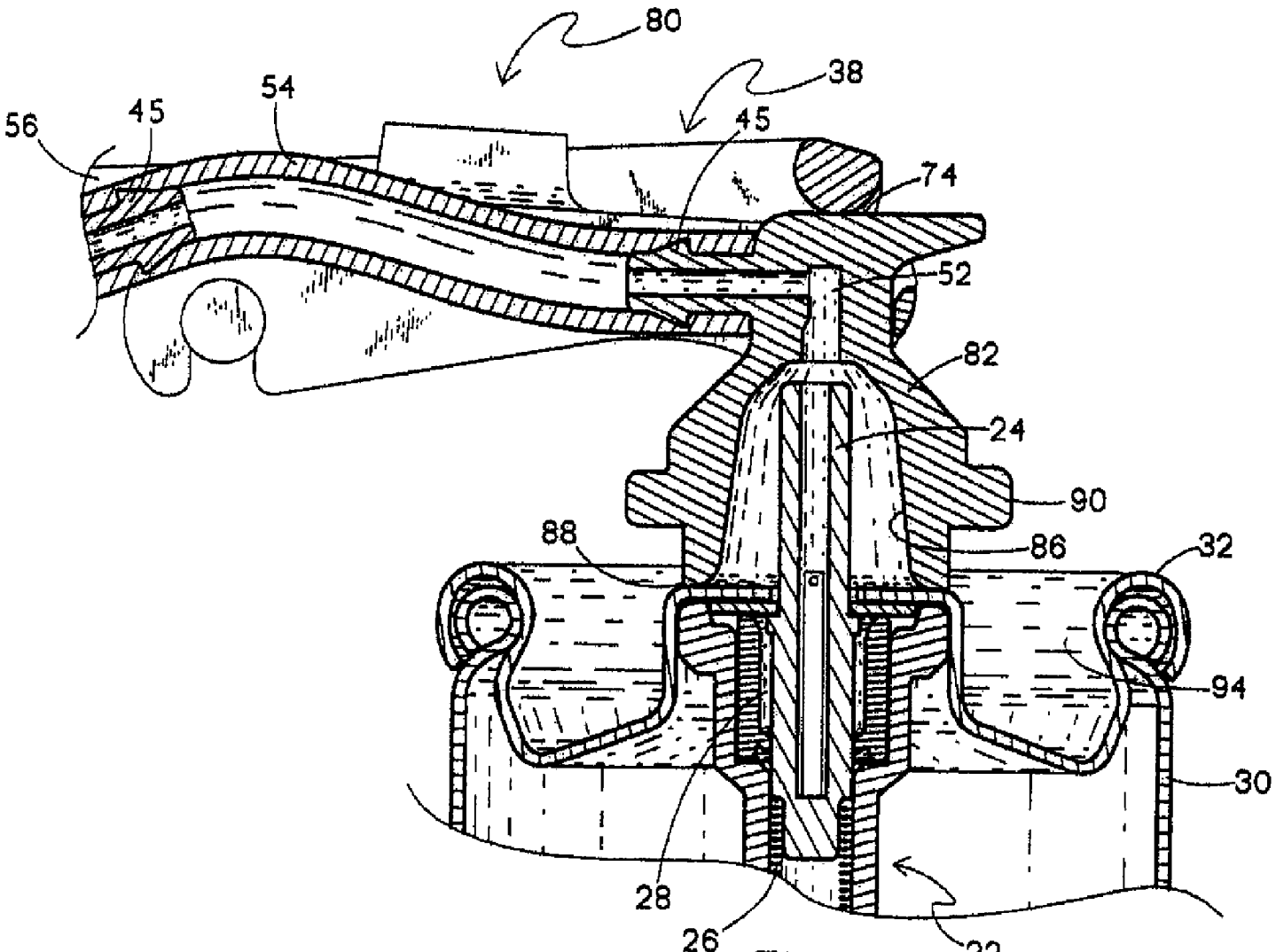
FIG. 4 is a fragmentary vertical cross-section of the present fuel cell actuator system engaged on a fuel cell lacking an adapter.

Referring now to FIGS. 3 and 4, the present combustion-powered fastener driving tool or combustion nailer is generally designated 80. Components shared with the tool 10 are given identical reference numbers. The main distinction between the tool 10 and the tool 80 is that the stem receiver block 44 is replaced by an actuator block 82, which delivers fuel to the fuel conduit 54 and ultimately to the combustion chamber 14 in the same way as does the stem receiver block. A main feature of the actuator block 82 is that it is configured for preventing actuation of the main stem 24 by the actuator assembly 38 upon the fuel cell 20 being adapter-free. Since a specially designed adapter 84 is provided for use with the actuator block 82, a fuel cell without such an adapter will not be actuated. In this way the inadvertent installation of a conventional fuel cell requiring an external fuel metering valve into the tool 80 will result in an inoperable tool unless the proper adapter is provided. Thus, proper dosing of fuel to the tool 80 is enhanced.

More specifically, the actuator block 82 shares many components with the stem receiver block 44, but also defines a stem cavity 86 dimensioned to envelop the main stem 24 without contacting the stem when the fuel cell 20 is adapter-free. As seen in FIG. 4, the stem cavity 86 is generally conically shaped, however other shapes are contemplated provided the stem 24 is enveloped and is not actuated unless the adapter 84 is present. The cavity 86 has sufficient height to accommodate the stem 24 in its rest position (FIG. 4), and includes a further clearance above the stem to accommodate movement caused by the pivot member 62 without actuating the stem. Included on the actuator block 82 is a free end 88 configured for contacting the fuel cell closure 32, which seats the block 82. Also included on the actuator block 82 is a radially projecting flange 90 for more accurately locating the block within the adapter 84.

Figure 6:
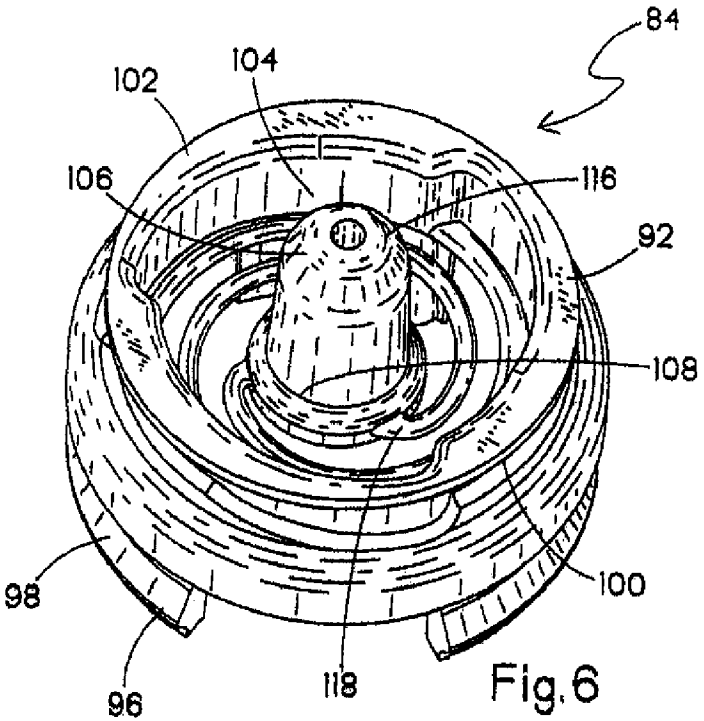
FIG. 6 is a top perspective view of the present fuel cell adapter.
Figure 5:
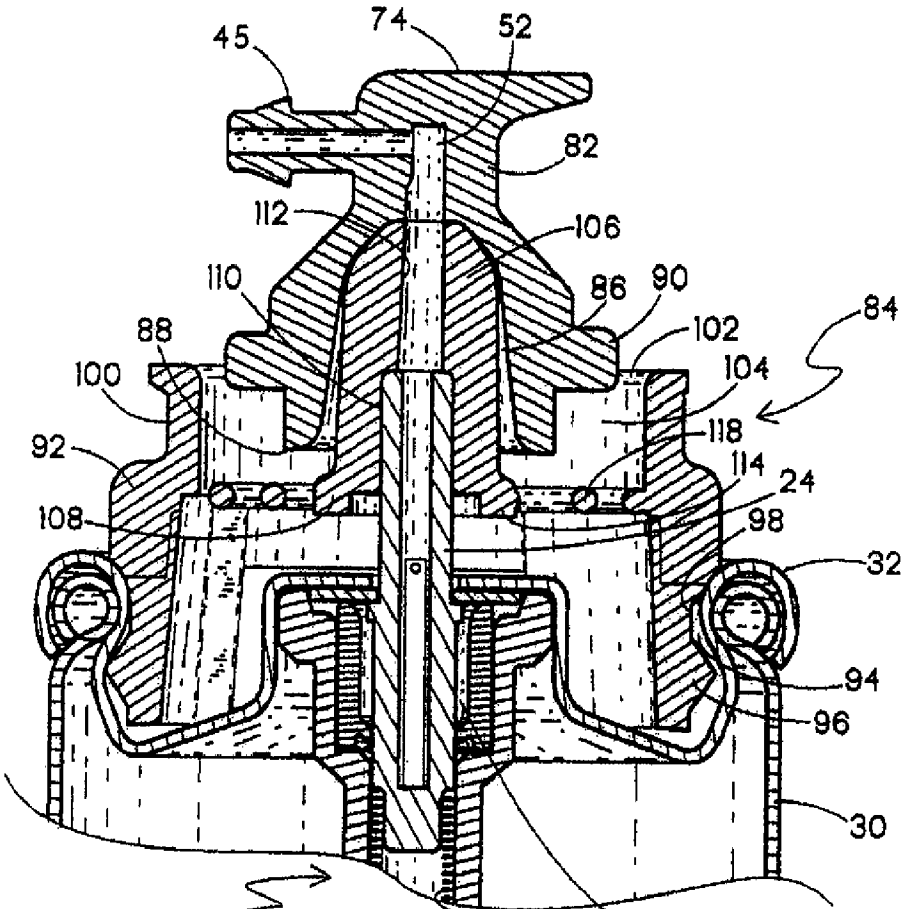
FIG. 5 is a fragmentary vertical cross-section of a fuel cell having an internal metering valve and equipped with the present adapter in operational relationship with the present fuel cell actuator system.
Figure 7:
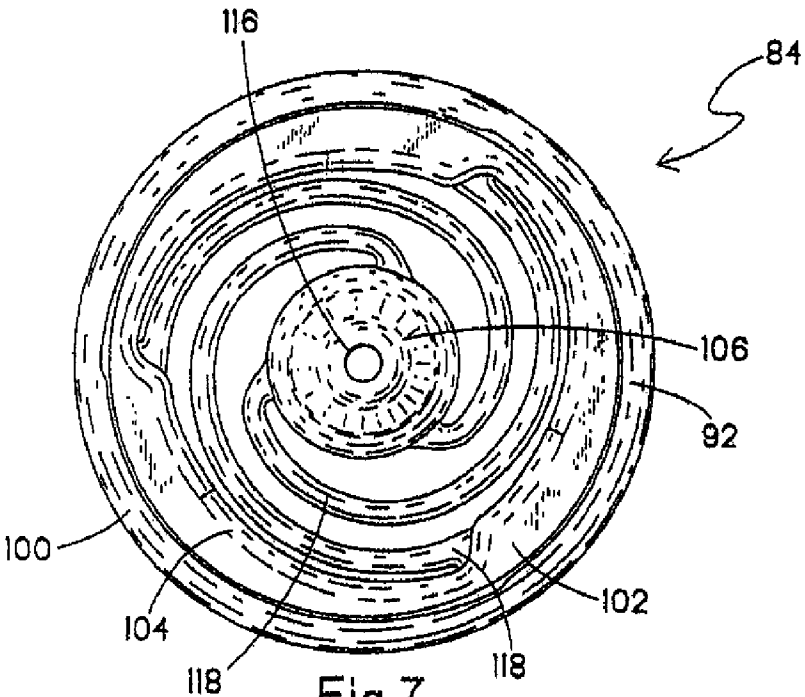
FIG. 7 is an overhead plan view of the fuel cell adapter of FIG. 6.

Referring now to FIGS. 5-7, the adapter 84 is described in greater detail. A main portion of the adapter 84 is the adapter body 92 which is generally cylindrical in shape and is dimensioned to fit snugly within an annular ring 94 formed by the fuel cell closure 32. A tight friction fit of the adapter 84 with the closure 32 is enhanced by at least one radially extending gripping formation 96, which defines an annular groove 98 for tightly engaging the ring 94. The formation 96 can be provided in a single closed ring or a series of spaced protrusions. To reduce the possibility of a user accidentally using a fuel cell not equipped with an internal metering valve, the adapter 84 is designed to be extremely difficult to remove from the closure 32. This is accomplished by dimensioning the gripping formation 96 and the groove 98 to have an extremely tight friction fit with the closure 32. In addition, in that the adapter 84 is preferably molded of a plastic material, a material is selected for stiffness, as well as for fuel resistance, moldability and durability. It is contemplated that acetyl, commonly sold under the trademark Celcon® by Hoechst Celanese, Charlotte N.C., is a preferred material, however other acetyls, polyamids or other fuel resistant plastics may be suitable.

An upper portion of the adapter body 92 defines a locator ring 100 with an open upper end 102 for receiving the actuator block 82 (FIG. 5). An inner chamber 104 is defined in the adapter 84 by the body 92 and is provided with a hub 106 which is reciprocally movable relative to the adapter body 92 and has a first end 108 configured for operationally engaging and being in fluid communication with the main stem 24, having an internal bore 110 in communication with a fuel throughbore 112. The internal bore 110 is dimensioned for tightly and slidingly receiving the main stem 24 of fuel cells 20 having internal metering valves. In addition, the bore is dimensioned so that main stems of fuel cells not having internal metering valves will not fit properly. The throughbore 112 is in fluid communication with the main stem 24 as well as the passageway 52.

Also on the first end is an annular foot 114 which acts as a stop against the fuel cell closure 32. This stop is important in restricting the amount of depression of the main stem 24 through operation of the actuator 38 or other vertical force, even that generated by a user. Excessive depression of the main stem 24 may cause more than the predetermined dose of fuel to be dispensed.

A second end 116 of the hub 106 opposite the first end 108 is configured for engaging and being in sealed fluid communication with the actuator block 82. Preferably, the second end 116 of the hub 106 and the stem cavity 86 are complementarily shaped to have a tight friction fit. This tight fit facilitates physical connection between the hub 106 and the block 82 and maintains a sealing relationship to prevent fuel leakage. However, additional fastening and sealing formations, such as lugs and detents, locking clips, annular lip seals or crush ribs or other fastening and sealing formations for releasably and sealingly securing the actuator block 82 upon the hub are contemplated.

A feature of the adapter 84 is that the hub 106 is reciprocally movable relative to the body so that the hub can follow the cyclical movement of the main stem 24. Thus, the hub 106 accommodates the motion induced into the system by the actuator 38, as well as by the spring 26 in the fuel cell 20. In the preferred embodiment, the reciprocal movement is provided by at least one curved flexible member 118 which is secured at a first end to the adapter body 92 and at an opposite end to the hub 106. The flexible members 118 are designed to add only a negligible force to that required to depress the fuel valve stem 24 in the fuel cell 20. In construction, the flexible members 118 are spiral in shape and have a generally circular cross-section to enhance the flexibility while reducing torsional stiffness.

There are preferably three curved flexible members 118, and they basically suspend the hub 106 relative to the body 92. In addition to the suspending function, the flexible members 118 bias the hub to a rest position shown in FIG. 5. Upon receipt of a force from the actuator 38, the hub 106 is depressed as the fuel stem 24 is also depressed against the force of the spring 26. Further, the flexible members 118 are sufficiently flexible that they compensate for manufacturing variations between the hub 106 and the valve stem 24 and facilitate proper location of the hub upon the stem.

Figure 8:
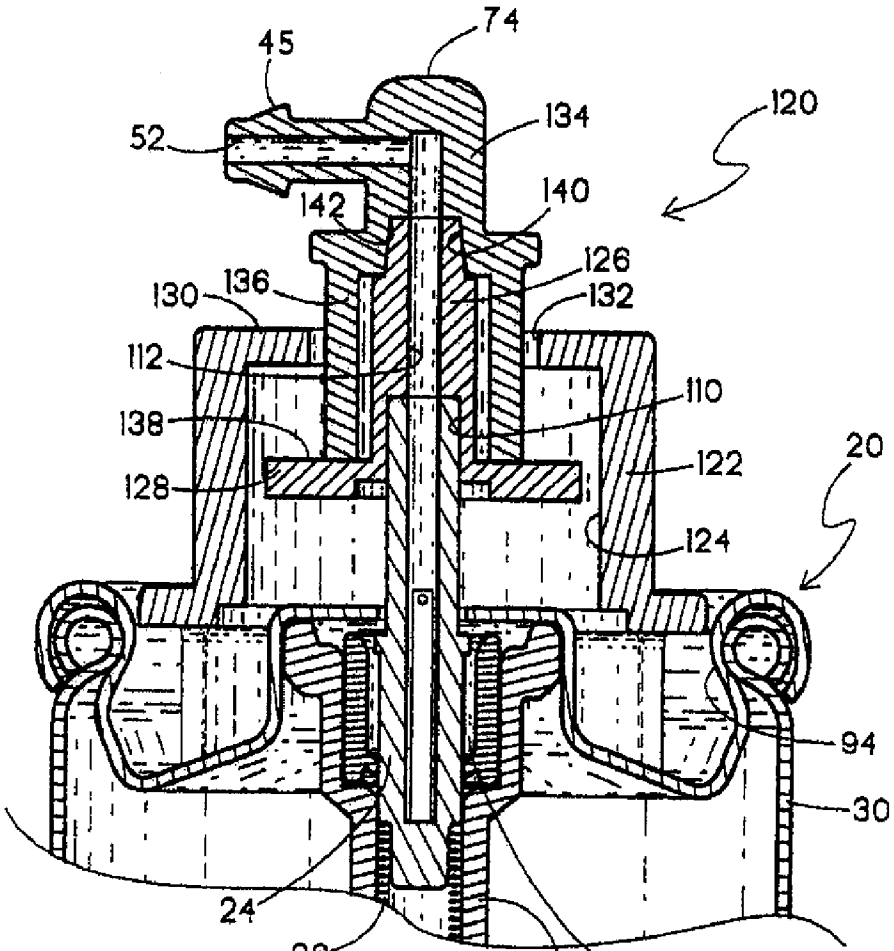
FIG. 8 is a fragmentary vertical section of an alternate embodiment of the present fuel cell adapter.

Referring now to FIG. 8, an alternate embodiment of the adapter 84 is generally designated 120. Components shared with the adapter 84 have been designated with identical reference numbers. Basically, the adapter 120 differs from the adapter 84 by being of two-piece rather than unitary construction. The adapter 120 includes an adapter body 122 which engages the closure annual ring 94 in a similar tight friction fit to the adapter body 92, however as shown the gripping formation is depicted as a plurality of peripherally spaced formations. A substantially closed chamber 124 is defined at an upper end of the body 122 and encloses the second element, which is a reciprocally moving hub 126. Included on the hub 126 is a radially extending flange 128 which is dimensioned to slidably reciprocate within the chamber 124, but is retained within the chamber by an upper lid 130 of the body 122 that closes off the chamber except for a preferably central opening 132. The degree of slidability of the hub 126 within the chamber at least corresponds to the vertical travel of the valve stem 24. Another function of the flange 128 is similar to the foot 114 in that it restricts the movement of the main stem 24. Thus, only one dose of fuel is dispensed at a time.

Included on the hub 126 is a lower end defining an internal bore 110 dimensioned to slidably receive the valve stem 24, and the fuel bore 112 in communication with the internal passageway 52 in a modified actuator block 134. The block 134 includes a depending sleeve 136 dimensioned to slidably and matingly engage the opening 132 and also to contact an upper surface 138 of the flange 128. As is the case with the adapter 84, in the adapter 120 the hub 126, shown with a truncated conical configuration 140, tightly yet releasably engages a complementarily-shaped recess 142 in the actuator block 134 so that there is tight, leak resistant fluid communication between the fuel cell valve stem 24 and the internal fuel passageway 52.

It will be seen that with the present fuel delivery apparatus, and specifically the actuator block 82, for fuel to ultimately be communicated from the fuel cell 20 to the combustion chamber 14, the adapter 84, 120 must be in place. Otherwise, the hubs 106, 126 will merely engage the fuel cell closure 32 and not the valve stem 24. Absent the adapter 84, 120, the actuator 38 will not actuate the valve stem 24.

While particular embodiments of the present enhanced fuel passageway and adapter for combustion tool fuel cells have been shown and described, it will be appreciated by those skilled in the art that changes and modifications may be made thereto without departing from the invention in its broader aspects and as set forth in the following claims.

The invention claimed is:

1. A combustion nailer configured for use with a fuel cell having an adapter, an internal metering valve and a reciprocating, biased main stem, comprising:

a tool housing defining a fuel cell chamber constructed and arranged for receiving the fuel cell;

a fuel cell actuator assembly configured for actuating the fuel cell in said chamber to emit a measured dose of fuel during tool operation when said fuel cell actuator assembly engages the adapter on the fuel cell; and a fuel delivery apparatus associated with said actuator assembly for receiving the emitted dose of fuel and providing it to a combustion chamber, said fuel delivery apparatus including an actuator block defining a stem cavity dimensioned to envelop the main stem without contacting the stem, to prevent actuation of the main stem by said actuator assembly when the adapter is absent from the fuel cell.

2. The tool of claim 1 wherein said actuator block includes a free end configured for contacting a closure of the fuel cell, and said stem cavity is dimensioned to accommodate actuation by said actuator assembly without actuating the main stem.

3. The tool of claim 1 wherein said actuator block has a fuel passageway in communication with said stem cavity and configured for engaging a fuel conduit.

4. The tool of claim 1 wherein said actuator block is provided with an engagement surface for accommodating said actuator assembly.

* * * * *